United States Patent [19]

Blair et al.

[11] Patent Number: 4,809,794

[45] Date of Patent: Mar. 7, 1989

[54] DETERMINING OF THE AMOUNT OF MATERIAL DELIVERED EACH OPERATIONAL CYCLE OF A SHOVEL LOADER

[76] Inventors: James R. Blair, 11 Langham Road, Nedlands, W.A.; Timothy W. Riley, 4 Riley Road, Kardinya, W.A., both of Australia

[21] Appl. No.: 23,865

[22] PCT Filed: Jun. 9, 1986

[86] PCT No.: PCT/AU86/00167

§ 371 Date: Feb. 4, 1987

§ 102(e) Date: Feb. 4, 1987

[87] PCT Pub. No.: WO86/07399

PCT Pub. Date: Dec. 18, 1986

[30] Foreign Application Priority Data

Jun. 7, 1985 [AU] Australia ..... PH0953

[51] Int. Cl.[4] ..... G01G 19/08; G01G 19/14; G01G 3/14

[52] U.S. Cl. ..... 177/139; 177/147; 177/211

[58] Field of Search ..... 177/139, 141, 146, 147, 177/211

[56] References Cited

U.S. PATENT DOCUMENTS

| | | | |
|---|---|---|---|
| 2,851,171 | 9/1958 | Martin et al. | 177/139 X |
| 3,339,652 | 9/1967 | Price | 177/147 X |
| 3,540,271 | 11/1970 | Hoff | 177/147 X |
| 4,055,255 | 10/1977 | Vasquez | 177/141 X |
| 4,230,196 | 10/1980 | Snead | 177/141 |
| 4,486,136 | 12/1984 | Howard | 177/147 X |
| 4,499,960 | 2/1985 | Ehrich et al. | 177/141 X |
| 4,677,579 | 6/1987 | Radomilovich | 177/147 X |

*Primary Examiner*—George H. Miller, Jr.
*Attorney, Agent, or Firm*—Dorsey & Whitney

[57] ABSTRACT

A method and apparatus for measuring the quantity of material delivered per cycle by a shovel loader having a bucket (22) that is moved between loaded and unloading positions. During the movement of the bucket in either direction between said positions, determinations are made of the location of the bucket with respect to two spaced points (27) and (17) on the structure (15) supporting the bucket. At the same time determinations are made as to the strain at a particular location in the support structure (15), that strain being related to total weight of the bucket and its contents. The bucket position determinations and the strain determinations are each provided as inputs to a processor programmed to calculate therefrom the weight of the bucket and contents, when loaded and unloaded, to thereby provide the weight of material delivered.

23 Claims, 4 Drawing Sheets

DETERMINING OF THE AMOUNT OF MATERIAL DELIVERED EACH OPERATIONAL CYCLE OF A SHOVEL LOADER

This invention relates to the determining of the amount of material delivered each operational cycle of a shovel loader. In particular the invention relates to effecting such determination in regard to a shovel loader comprising a base, a platform supported on the base for rotation relative thereto about a vertical axis, a boom connected to the platform at the lower end and at an upper portion to a stay structure mounted on the platform so the boom extends upwardly and outwardly from the platform, and a bucket supported suspended from the boom and displaceable therefrom in a vertical and horizontal direction.

It is desirable for a number of reasons to be able to determine the quantity of material delivered by a shovel loader both from the point of view of material delivered per operational cycle of the loader and total quantities over small large numbers of cycles.

Apart from ascertaining the total quantity of material moved in a day or a shift, when loading vehicles by a shovel, it is important to ensure the truck is not under or over loaded. Underloading is wasteful in regard to vehicle usage, and overloading is detrimental to vehicle wear and overall life.

It is therefore the object of the present invention to provide a method and apparatus that is effective in measuring the quantity of material delivered each operating cycle of a shovel loader, having regard to the environment in which the shovel loader operates and various factors influencing the accuracy of such measurements.

With this object in view there is provided a method of measuring the quantity of material delivered per cycle by a shovel loader having a bucket to hold the material to be delivered the bucket being movable between a loaded and unloading positions, said bucket being supported from a structure during movement between said positions, said method comprising determining the position of the bucket in respect to a selected location on said structure in the form of a processable position signal at one or more intervals during said movement, determining the load at a selected location within said structure where the load is related to the mass of the bucket and bucket contents in the form of a processable and load signal at said interval or intervals, and processing said position and load signals to determine the mass of the bucket and bucket contents at said interval or intervals.

More specifically there is provided a method of measuring the quantity of material delivered per cycle by a shovel loader comprising determining in the form of electrical signals the position of the bucket with respect to a selected location and the load at a selected location in the boom or stay structure at one or a number of intervals in the movement of the boom from a bucket loading to a bucket unloading position, providing inputs, generated by said signals to an electronic processor programmed to calculate therefrom the total weight of the bucket and contents at each interval, making further such determinations and inputs to the processor at one or a number of intervals in the movement of the bucket in the reverse direction between said position, and processing said inputs in the processor to provide a difference between the weight of the bucket during the two movements.

By determining the difference between the weight of the loaded bucket as it moves to the unloading position and weight of the empty bucket as it returns from the unloading position, the weight of the contents of the bucket actually deposited is ascertained. Preferably the processor determines an average of the weights calculated during the respective movements and provides a difference in these averages as the weight of the contents deposited by the bucket.

Conveniently the determinations are made at predetermine time intervals during the movement of the boom in each direction. The time intervals between the determinations are preferably equal.

These weight determinations may be initiated and terminated in response in suitable parameters, such as the position of the boom relative to the base of the loader, or the angular velocity or acceleration of the boom relative to the loader base.

Conveniently the initiation of the making of the determination of the weight of the loaded bucket may be in response to the bucket occupying a selected position relative to the boom that is indicative that the loading of the bucket has been completed.

The termination of weight determinations may similarly be in response to the bucket occupying a further selected position relative to the boom indicating the bucket is about to discharge its load. The initiation and termination of the determination of the weight of the unloaded bucket are similarly in response to selected positions in the movement of the bucket and/or boom.

It has been found that the accuracy of the determination of the weight of the load discharged is increased if the averaging of the determinations of weight of the loaded and unloaded bucket, does not include the determinations at or near the respective ends of the respective movements of the boom, particularly at the commencement of the movements. This is because at these periods substantial kinetic load may be experienced and these loads may fluctuate significantly within those periods. Accordingly, it is preferable to exclude from the averaging step a number of the weights calculated at one or both ends of the respective movements of the boom.

The position of the bucket relative to the boom may be determined by the measurement of the distance of a reference point on the bucket from two fixed points on the boom, one of which may be the pivot axis of the connection between the boom and the arm carrying the bucket.

Conveniently the bucket is coupled to a rigid member pivotally connected to both the bucket and the boom with the effective length of the member between these pivot connections adjustable. The bucket is also suspended from a sheath at the upper end of the boom, by a cable or cables. The bucket is raised or lowered by operation of a winch drum about which the cable or cables are wound.

The position of the bucket relative to the boom may be ascertained using suitable sensors which provide respective signals to the processor indicating the linear displacement of a reference point on the bucket from the connection of the member to the boom and the length of cable between the sheath and the bucket. The processor is programmed to determine from these signals the co-ordinates of the centre of gravity of the bucket with respect to an appropriate fixed reference on the loader platform or boom.

Strain gauges or other suitable load sensing means are provided to generate a signal having a known relation to the total weight supported by the boom. The strain gauges or sensing means may be arranged to determine the strain in a selected section of the boom or the stay structure interconnected between the boom and the loader platform. The electronic processor is programmed to calculate from this signal, and the signals received indicated the position of the bucket, the total weight supported by the boom, from which the total weight of the bucket and its contents is derived.

The processor is further programmed to make a series of such calculations when the bucket is loaded and after deposit of the load in any one cycle, and then determines the difference between the average loaded and unloaded weight support by the boom to achieve the weight of material delivered by the loader each cycle.

In many shovel loaders kinetic forces arising from the movement of such component as the bucket, bucket arm, boom, will give rise to stresses in the structural member in which the strain is being measured. Accordingly in order to correct for these kinetic forces in the bucket load determinations, the linear and angular velocity and acceleration of major components, such as the bucket and the platform supporting the boom, are sensed and fed to the processor. The processor is programmed with static information regarding the mass of the relevant components, and the physical relation thereof to the structural member, so that, with sensed formation regarding the velocity and/or acceleration experienced by the components, the processor can effect the necessary compensation for kinetic forces in determining the bucket load.

An example of such forces encountered during the movement of the bucket from the loading to the dumping position, where that movement is a swinging movement about a vertical axis, is the centrifugal forces acting on the bucket, boom and other component having rotary motion. It will be appreciated that the kinetic forces that induced strains in the structural member, wherein strains are measured for load determinations, will be dependent on the overall physical construction of the shovel loader. However, the relevant forces can redaily be identified by suitable analysis of the structure, and appropriate programming incorporated in the processor to compensate for these forces in the bucket load determinations.

The position of the bucket relative to the boom may be determined by suitable electronic sensors such as optical encoders. As previously referred to the bucket may be coupled to a rigid member pivotally connected to both the bucket and the boom with the effective length of the member between these pivot connections adjustable, and the bucket also suspended from a sheath at the upper end of the boom, by a cable or cables coupled to a winch drum. Accordingly, the length of cable between the bucket and the sheath is a controlling factor in the position of the bucket relative to the boom. The winch drum is driven by an electric motor through suitable gear train, and an optical encoder is coupled to the gear train so the signal output therefrom is related to the length of cable between the sheath and the bucket. An electric motor is provided coupled via a suitable speed reduction, to a drive mechanism that extends the member relative to the boom, and an encoder is coupled to the drive so that rotation thereof is proportional to the degree of extension of the member. The output from the two encoders may be fed to the electronic processor through, if necessary, appropriate amplifiers, and the computer program can determine from these signals the actual disposition of the centre of gravity of the bucket relative to a selected reference point on the boom, such as the lower point of connection of the boom to the platform or shovel loader, or the upper point of connection of the boom to the stay structure.

In this regard, it is to be understood that the boom primarily retains a fixed position relative to the platform during the normal operation of the shovel loader. However, if the constructions of the shovel loader is such that the boom position may be varied during operation, then a further encoder would be provided to produce a signal to indicate the angular disposition of the boom to the platform, and that signal would be a further input to the processor, which would be programmed to also take into account this inclination when determining the position of the bucket. The output of such an encoder may also be processed to provided measurement of the velocity and/or acceleration of the various structural component for the purpose of determining kinetic force.

Normally, the upper portion of the boom is connected to the stay structure by a rigid or flexible member or members, which are arranged so as to be under tension under all operating conditions. In the alternative construction wherein the inclination of the boom may be adjustable, these tension members may also be in the form of cables, which can be extended or retracted as required. The tension member, whether of a fixed or variable length, is connected to or passed around a rigid strut or stay rigidly secured to the platform. The strain in the tension member or the strut or stay thus has a calculable relationship with the load supported by the boom. It is therefore possible to locate a suitable strain or stress sensing device on the tension member or another appropriate member or members in the stay structure, which will produce a signal having a calculable relationship to the weight supported by the boom. It is preferable for the sensor to be attached to a rigid member rather than a flexible member, as this reduced the complexity of the relationship between the stress or strain in that member and the load supported by the boom.

The intervals at which the readings are taken to record the position of the bucket, and the strain in the relevant member of the stay structure, are identical. The initiation of recording and processing of bucket position and strain readings is determined by sensing the commencement of the movement of the boom beyond a predetermined point in its rotary movement relative to the platform, or the movement of the bucket beyond a preselected location relative to the boom, such location being selected as one which the bucket occupies during transit, and does not occupy during normal collection of the material into the bucket.

Similarly, at the deposit end of the movement of the bucket, a sensor is provided to determine the commencement of depositing of the material. Such a sensor may be related to the release of the door of the bucket to deposit the material.

The initiation and termination of the recording of the signal indicating the bucket position and strain in the stay structure may be in response to the platform supporting the boom passing through selected angular relationships to the shovel base. The rotation of the platform relative to the base is achieved by an electric motor driving through a suitable gear box. A suitable encoder may be coupled to this drive train, via a further gear reduction is necessary, so that encoder effects one revolution for a complete revolution of the platform. Accordingly, after appropriate calibration the relative angular position of the platform, and hence of the boom mounted thereon, can be sensed by the processor on the basis of the output from the encoder.

This arrangement enables the processor to initiate and terminate the recording of the signals indicating the bucket position and stay structure strain within a selected range of angular relationships between the boom and the shovel base. The particular range being selected to within the range of movement between the loading and unloading position of the bucket. The direction of the changes in the encoder reading, ie. increasing or decreasing, will indicate to the processor the direction of movement of the boom.

There is also provided by the present invention in a shovel loader having a bucket supported from a structure, the structure being movable to locate the bucket in respective loaded and unloading positions, and apparatus for measuring the quantity of material delivered by the bucket per shovel cycle, said apparatus comprising means to determine the position of the bucket with respect to a selected location in the structure at one or more intervals during said movement of the bucket, means to provide a processable position signal indicative of the determined position of the bucket, means to determine the load at a selected location within the structure where the load is related to the mass of the bucket and bucket contents at said one or more intervals during said movement of the bucket, means to produce a processable load signal indicative of the determined load at said location, and processor means to receive said position and load signals and determine therefrom the mass of the bucket and bucket contents.

The invention will be more readily understood from the following description of application thereof to a known dipper type of shovel loader and with reference to the accompanying drawings.

Figure 4:
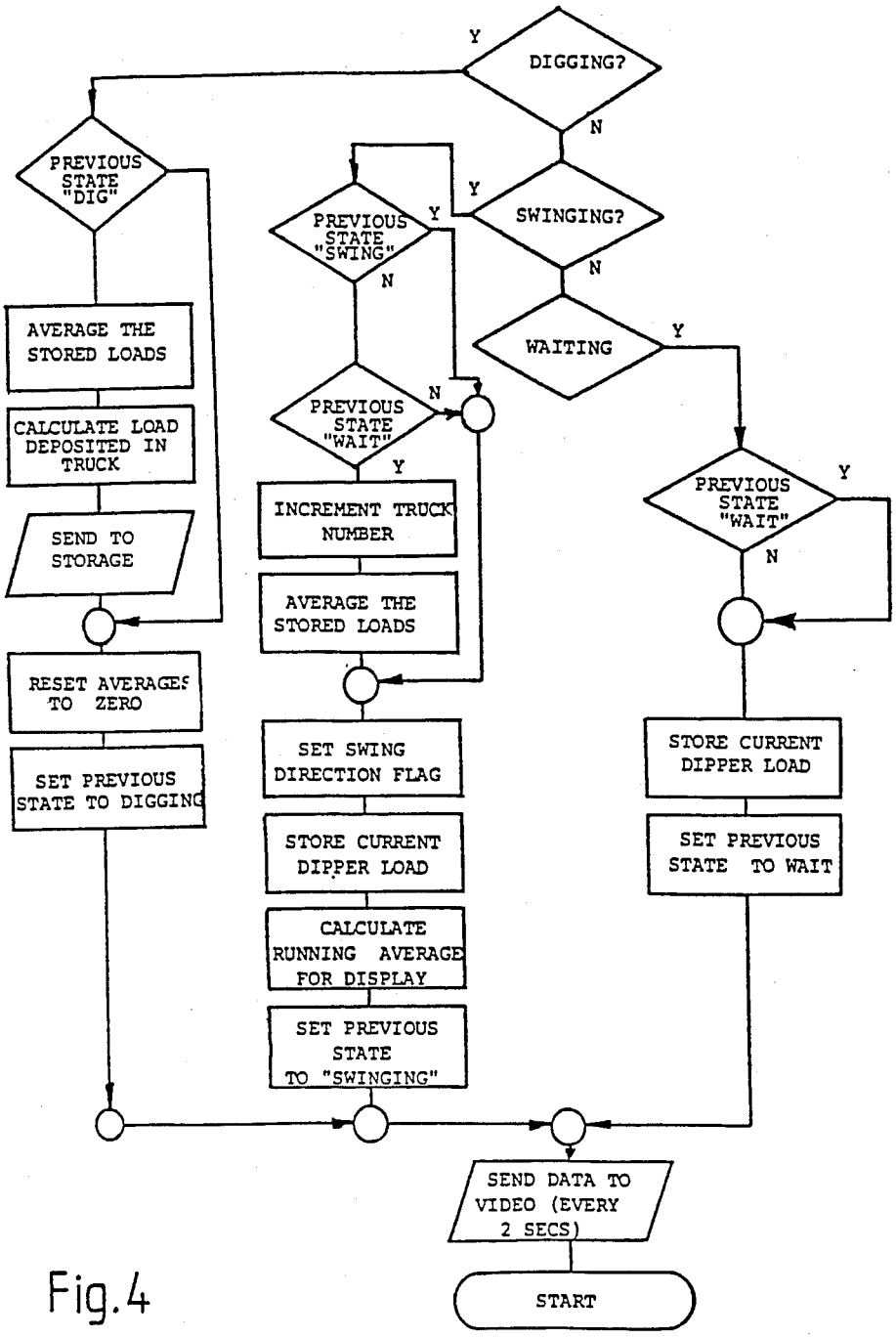

FIG. 8 and 4 together are a logic diagram from the program of the processor.

Figure 5:
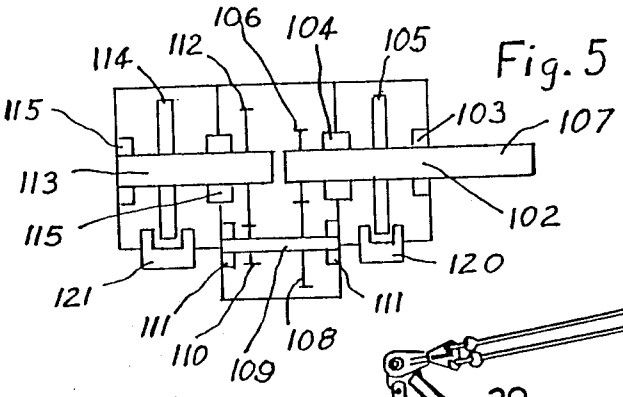

FIG. 5 is a diagrammatic representation of an optical encoder for signaling to the processor the position of various components of the shovel loader.

Figure 1:
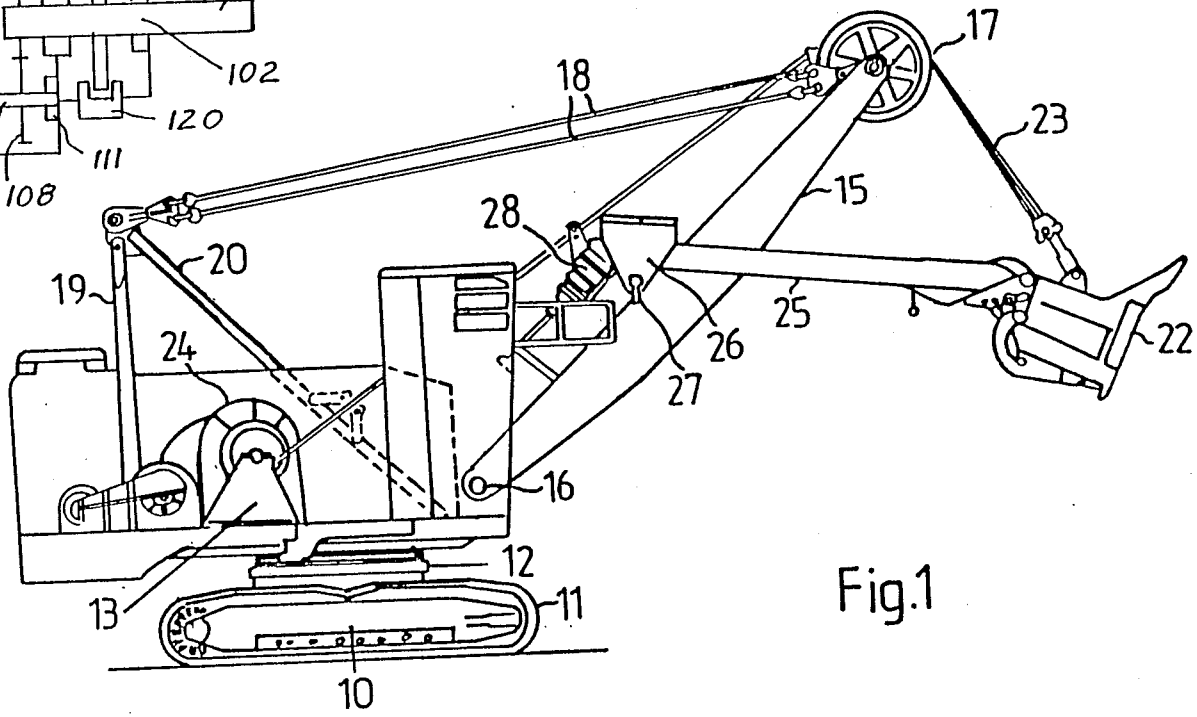
FIG. 1 is a simplified drawing showing the general construction layout of the dipper shovel loader.

Referring to FIG. 1 the shovel loader depicted therein of the well known construction commonly referred to as a dipper shovel loader. This shovel loader comprises a mobile base 10 supported on drive tracks 11, and having supported thereon through the turntable 12, a machinery deck 13. The turntable 12 pemits full 360° rotation of the machinery deck relative to the base.

The boom 15 is pivotally connected at 16 to the machinery deck, and carriers at the upper end a cable sheath 17. The boom is held in a fixed upwardly and outwardly extending relation to the deck by the tension cables 18, which are anchored to the back stay 19 of the stay structure 20, rigidly mounted on the machinery deck 13.

The bucket or dipper 22 is suspended by the cable 23 from the sheath 17, the cable being anchored to the winch drum 24 mounted on the machinery deck 13. The dipper has an arm 25 rigidly attached thereto, with the dipper arm 25 slidably supported in the saddle block 26, which is pivotally mounted on the boom 15 at 27. The dipper arm has a rack tooth formation thereon (not shown) which engages a drive pinion, (not shown) mounted in the saddle block 26. The drive pinion is driven by an electric motor and transmission unit 28 to effect extension or retraction of the dipper arm 25 relative to the saddle block 26.

An engine driven electric generator is mounted on the machinery deck to provide power to respective electric motors which drive the winch drum 24, saddle block transmission unit 28, and machinery deck turntable 12. As previously explained, the position of the dipper 22 relative to a selected fixed reference point of the boom 15 may be determined by knowning the extent of projection of the dipper arm 25 with respect to the saddle block 26 and the effective length of the cable 23 between the sheath 17 and the dipper 22. The above described basic construction of the shovel loader is widely known and used and further details of the construction are not provided as they are well known in the art.

In the operation of the shovel loader a basic series of movements of the dipper are associated with each delivery of material to the truck or the like. Although the operator may perform other operations with the dipper between deliveries of the material to the truck, it is possible to recognise when the loader is delivering material to the truck and when it is merely being operated to clean up loose material in the loading vicinity or carrying out such other operations that are not directly involved in a loading sequence.

The sequence of loading operations are:

1. Loading the dipper with material wherein the dipper is in a lowered position.
2. Raising the dipper to an elevated position.
3. Swinging the dipper whilst in an elevated position about the vertical axis from a digging position to an unloading position.
4. Opening the dipper door when the dipper is in the unloading position.
5. Returning the dipper from the unloading position to the digging position.
6. Closing the dipper door when the dipper is moving towards the digging position.

As, in the preferred operation, the load weighing procedure is carried out while the dipper is swinging in the raised position, it is convenient to arrange that processor only places in store dipper load calculations made whilst the dipper is in a raised position. This raised position can be readily determined by the angular relationship between the dipper arm 25 and the boom 15. The processor can determine this angle from a calculation based on the length of cable played out from the winch drum 24 and the position of the dipper arm 25 relative to the saddle block 26 determined by the position of the rack on the dipper arm relative to the driving pinion, and load calculations made whilst in that position would not be considered in calculating the loaded or unloaded weight of the dipper.

Determination that the dipper is swinging can be obtained by detecting rotation of the motor driving the turntable 12 or of a component in the turntable drive transmission. This is conveniently achieved by an optical encoder unit incorporating a member coupled to the turntable drive to rotate in a fixed speed relation to the machinery deck rotation. The extent of angular movement of the machinery deck, and the angular velocity and acceleration thereof can be calculated by the processor from the signals received from the encoder. The general construction and operation of the optical encoder is described hereinafter.

The processor is thus able to determine, from the turntable encoder, when the boom 15 and dipper 24 are swinging between the digging and dumping positions in either direction, and make the dipper load calculations during those periods. As previously referred to these calculations are made at fixed time intervals, during the swinging movement, and calculations made during the initial and terminal portion of the swinging movement are discarded in the load averaging to avoid the effects of kinetic forces in the shovel loader structure. The load calculation to be discarded can be counted from the initial and final signal received from the turntable encoder in each swinging movement.

A similar optical encoder unit is incorporated in the drive of the winch drum 24 so tht the length of cable played out from the winch drum can be calculated from the rotation of the drum. The processor can calculate from this the distance between the centre of mass of the dipper and the axis 35 of the sheath 16, this being one co-ordinate in determining the position of the dipper. Again the encoder unit will provide velocity and acceleration data to be used in determining kinetic forces arising from the dipper movement.

A further optical encoder unit is incorporated in the drive of the pinion that extends or retracts the dipper arm 25 relative to the saddle 26. From this input the processor can calculate the distance between the centre of mass of the dipper and the axis 27 of the pivot connection between the saddle 26 and the boom 15.

Accordingly, from the encoder units on the winch drum drive and the dipper arm drive the processor has co-ordinates of the centre of mass of the dipper in respect of the two fixed points on the boom 15.

Knowning the co-ordinates of the centre of mass of the dipper in respect to fixed points on the boom it can be determined mathematically the strain that the weight of the dipper and its contents induce in any part of the boom or its support structure. Conversely knowing the strain in a selected part of the support structure and the disposition of the centre of mass of the dipper the weight of the dipper and its contents can be calculated. In such a calculation account will have to be taken of the other strain inducing loads act on that part of the structure including kinetic loads.

Accordingly, by suitably programming the processor and providing signals thereto regarding the position of the dipper, and the strain in a selected part of the structure the processor can determine the weight of the dipper plus contents if any. It will be appreciated that the actual program will part with the construction of the shovel loader and the location of strain measurement. However, the development of the particular mathematic formula and a program based thereon is within the skill of competent engineers.

In a shovel loader of the configuration shown in FIG. 1 it has been found that a desirable location of strain gauges is on the vertical member of the back stay 19. The strain in the back stay is of a less complex nature than that it many other areas of the structure, and has a relatively convenient relationship to the weight of the dipper and its contents.

Figure 2:
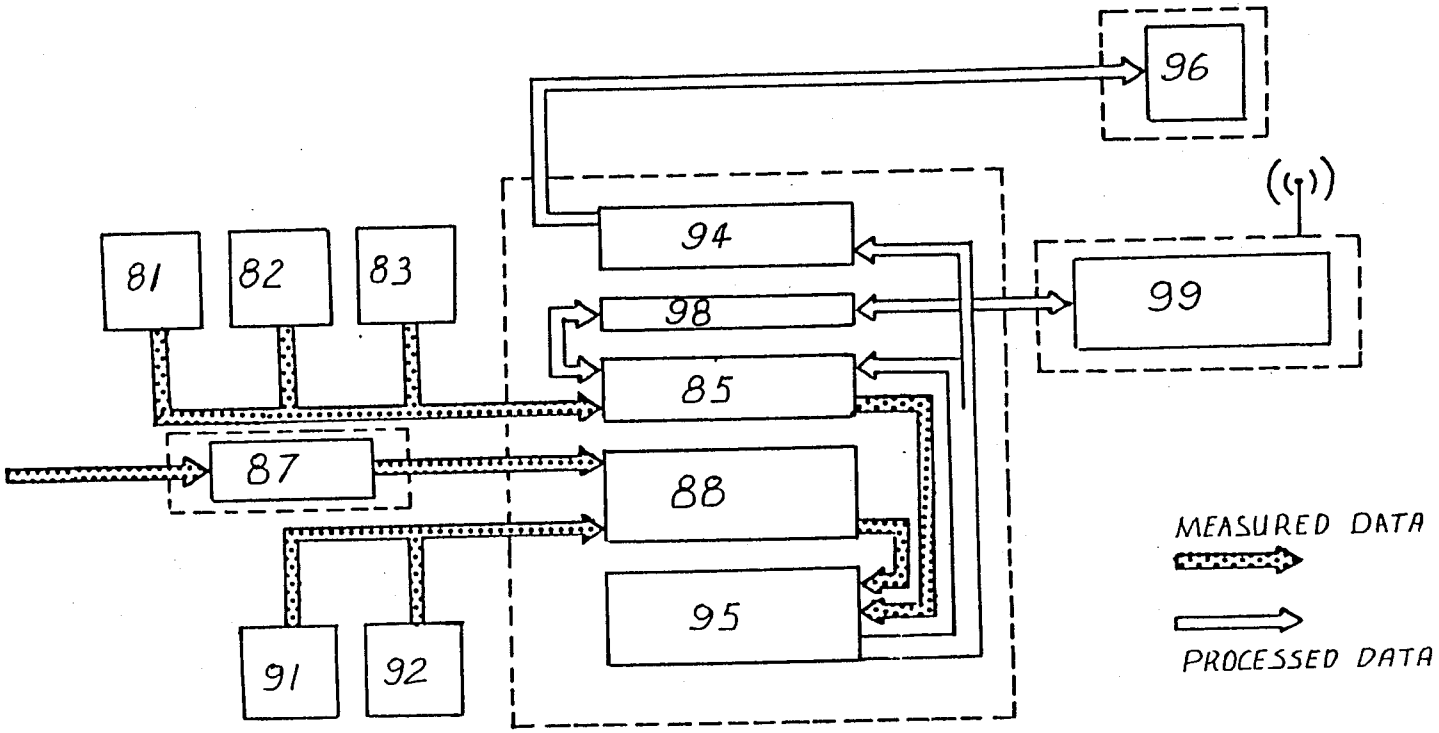
FIG. 2 is a diagrammatic representation of the various sensors and processors used in effecting the dipper load determinations.

FIG. 2 of the drawings shows one functional arrangement of the various encoders and processors to perform the present invention, as applied to the dipper type shovel loader described with reference to FIG. 1.

The winch drum, dipper arm, and turntable optical encoders previously referred to are represented at 81, 82 and 83, and each provide serially information to the secondary processor 85 which prepares the encoder information for processing by the main processor 95. Other basic information regarding the operating condition of the loader is provided from the shovel control 86 via the interface unit 87 and the converter 88 to the main processor 95. This other basic information relates to whether the shovel is the operating condition, whether the shovel is performing loading operation, or is in a mobile state, moving between working site etc. This information is relevant to the main processor deciding if the shovel is delivering material, and therefore the processor should make a weight calculation.

The strain gauge units 91 and 92 are mounted of the two upright members forming the back stay 19 in FIG. 1 and produce a signal proportional to the strain in said back stay. This signal is also passed through the converter 88 to the main processor 95.

The main processor is programmed as previously discussed to calculate from the inputs the weight of the bucket and contents for each position and load determination, and to provide an average weight for each loaded and unloaded cycle of the shovel.

The resultant weight of material delivered each cycle as calculated by the main processor 95 is passed to the solid state storage of the secondary processor 85. The secondary processor can on a radio link transmitted command of a remote base computer transfer information from the secondary processor memory to the base computer via the radio modem 98 and radio unit 99.

The operator display 96 is suitably located for viewing by the shovel operator, and via the graphic processor 94 receives regularly updated information regarding the weight of material delivered each cycle of the shovel and the total weight delivered to each truck.

Suitable commercially available processors for use in the above described arrangement are:

| | |
|---|---|
| Main Processor | Motorola MC68000 |
| Secondary Processor | Motorola MC6802 |
| Graphic Processor | Motorola MC6802 |

Figure 3:
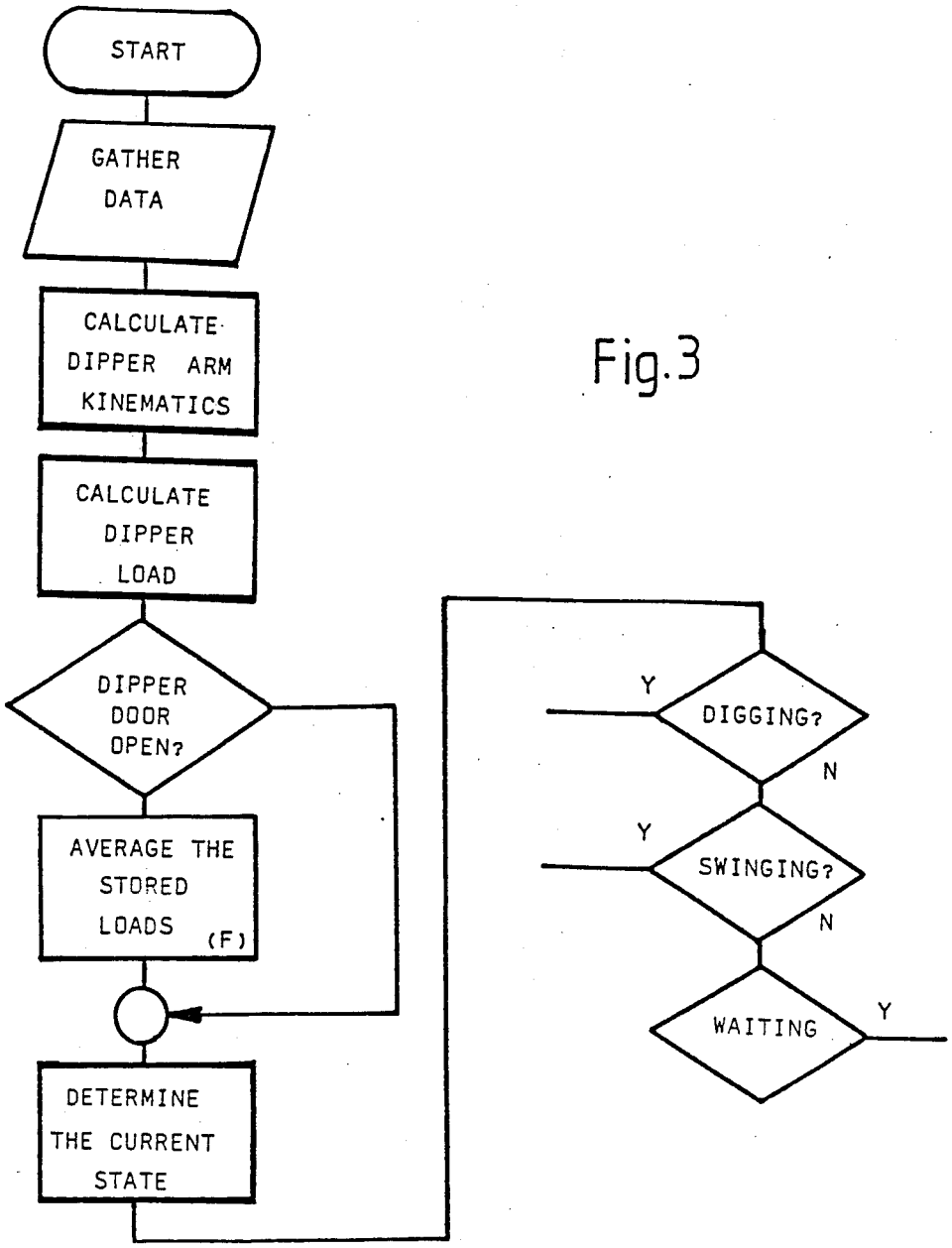

Referring now to the simplified logic diagram of FIG. 3 and 4 the basic decision and operations of the processor will be described. This sequence of decisions and operations is performed as follows at a set time interval while the shovel is in operation.

1. data gathered from the various encoders and the strain gauges;

2. calculate the kinematic behavior of the dipper arm from the encoder information;

3. calculate the dipper load from the strain gauge information for the particular kinematic behaviour of the dipper;

4. determine if the dipper door is open.

a. If the door is open, indicating that the dipper is in transit after dumping a load, the calculated dipper load is stored for subsequent averaging.

b. If the dipper door is closed the dipper may be in one of three states.

1. "digging" material to fill the dipper.

2. "swinging", that is in transit, between the dipper loading and dipper dumping positions.

3. "waiting" in a position to dump into a truck, the truck not being in position to receive.

The processor determines in which of these three stages the dipper is as previously discussed and there proceed in accordance with that determination.

The decisions and operations of the processor followed in each of these states of the dipper will now be described with reference to FIG. 4 under the three headings "Digging", "Swinging" and "Waiting".

Digging.

1. determine the state of the dipper at the time of the previous cycle.

a. if the dipper was also digging in the previous cycle the current dipper load calculation is not be stored. Accordingly the stored average dipper load will be reset to zero, and the previous state memory set to "digging".

b. if the state of the dipper was not "digging" on the previous cycle then the dipper has just completed a return swing after dumping material in the back. The processor now averages the dipper load calculations stored during the return swing of the dipper to determine the average empty dipper weight. The processor will have stored therein the average full dipper weight as determined during the preceding swinging movement of the dipper from the digging to the dumping position, and now calculates the weight of material dumped by subtracting the empty dipper weight from the full dipper weight. The determined dumped weight of material is transmitted to a secondary processor and stored for subsequent retrieval such as by transmission by radio link to a remote storage or further processing facility. The determined dumped weight is also transmitted to visual display for shovel operator viewing. Thereafter stored average dipper weight is reset to zero and the previous state memory set to "digging".

Swinging.

1. Determine the state of the dipper at the time of the previous cycle.

a. if the dipper was swinging during the previous cycle, a check is made that the direction of swing is the same and if so the dipper load is calculated and stored, and the current average dipper load for that particular swing is calculated for operator display. This sequence is repeated each cycle so long as the dipper is swinging in the same direction and until the dipper door is opened indicating a change in direction of swing as previously discussed. The average dipper load on the operator display is only updated each 2 secs.

b. If the dipper was "waiting" during the previous cycle this indicates that the loaded dipper is in position to dump a load into a truck, but the truck is not in position. This means that the previous truck has been filled and departed and a further truck is to move into position. The processor is thus advised a change of truck is in progress and enters this to the memory and totals the load delivered to the previous truck and transmitted same to the secondary processor and stored.

Waiting.

While in the waiting state there are no changes taking place so that the current calculated dipper load is stored and the previous state set at waiting. This cycle repeats until a change of state is signaled.

It will be understood that the dipper enters the "waiting" state at the end of a swing in one direction, with the dipper load, and leaves the waiting state at the commencement of a swing in the opposite direction. While in the waiting state the dipper door will be operated to open and deposit the load in the truck. Thus the operator initiated opening of the dipper door is used to signal to the processor a change in direction of swing. Similarly the closing of the dipper door occurs at the end of the return swing of the dipper to the digging position and so along indicate the pending next change of direction of swing of the dipper.

Reference has previously been made to optical encoders coupled to the electric motors or transmissions which drive the winch drum, the dipper arm pinion, and the turntable, as sensors to determine the position and movement of the respective components. Encoders for these purposes may be of any known form having the required capacity and accuracy. One comparatively simple but effective form of encoder is shown diagrammatically in FIG. 5.

The encoder comprising and input shaft 102, journaled in bearings 103 and 104, and carrying the first coded disc 105 and pinion 106. The end portion 107 of the shaft 102 is in use coupled suitably to the motor or transmission driving the component, the position of which is being monitored, such as the winch drum or turntable.

The pinion 106 drives the gear 108 mounted on the lay shaft 109, on which is also mounted the gear 110. The shaft 109 is supported in bearings 111 at each end, and the shaft 109 and gears 108 and 110 rotate in unison. The gear 110 drives gear 112, mounted on shaft 113 carrying the second coded disc 114. The shaft 113 is supported in bearings 115 and the shaft 113, gear 112, and second coded disc 114 rotate in unison.

The two gears trains 106–108 and 110–112 provide a double reduction in speed between the first and second codes discs 105 and 114. This speed reduction is selected so that the second coded disc 114 will advance one code interval for each revolution of the first coded disc 105. The speed reduction between the first coded disc and the member driving it is selected, having regard to the relative movement of the component being monitored by the encoder. The second coded disc 114 is required to effect no more than one complete revolution for the full extent of movement of the monitored component.

Each coded disc 105, 114 is provided with an optical code pattern around its perimetal area, of any suitable form, such as the 'Grey Pattern'. A light source and receiver units 120 and 121 are provided for the respective discs 105, 114 to generate with the perimetal pattern a digital signal indicative of the rotational position of each disc. It will be appreciated that the signal from the first disc 105 divides each interval of the second disc 114 by the number of intervals on the first disc. Accordingly, the output from the two discs provide an accurate tracking of the position of the component being monitored.

In addition, the signal from the first coded disc can be processed to provide velocity and acceleration data in respect of the monitored component.

It will be understood that the mathematical formula upon which the programme of the processors is based will be dependent on a number of factors including the general geometry of the shovel loader structure supporting the bucket, the particular location of the strain gauges or the like on the structure, and the fixed points selected on the structure from which the bucket coordinates are measured. However, the formula are based on fundamental engineering principles well known in the art and by those skilled in the art.

We claim:

1. A method of measuring the quantity of material delivered per cycle by a shovel loader having a bucket to hold the material to be delivered, the bucket being movable between loaded and unloading positions, said bucket being supported from a structure during movement between said positions, said method comprising determining the position of the bucket in respect to a selected fixed location on said structure in the form of a processable position signal at a plurality of intervals during the movement of the bucket between said loaded and unloading positions, determining the load at a selected fixed location within said structure where the load is related to the mass and position of the bucket and bucket contents in the form of a processable load signal at each said interval, processing said position and load signals for a plurality of interval determinations to provide a number of mass determinations of the bucket and bucket contents from the interval determinations made during said movement, and averaging said mass determinations to provide a final determination of the bucket and bucket contents.

2. A method as claimed in claim 1 wherein first position determination and first load determinations are made as the bucket moves from the loaded to the unloading positions, and second position determinations and second load determinations are made as the bucket returns from the unloading position toward the load position, processing said position and load signals from said first position and load determinations to provide a final mass determination of the bucket and bucket contents when the bucket is loaded, processing said position and load signals from said second position and load determinations to provide a final mass determination of the bucket and bucket contents after the bucket has been unloaded, and processing said final mass determinations of the laoded and unloaded bucket to determine the mass of material delivered from the bucket.

3. A method as claimed in claim 1 or 2 wherein the position of the bucket is determined by determining the distance from a selected point in the bucket to two spaced fixed points of the structure, said two spaced fixed points having a fixed relation to the location at which the load in the structure is determined.

4. A method as claimed in claim 1 or 2 wherein the structure is mounted for movement about a vertical axis to effect movement of the bucket between said loaded and unloading positions.

5. A method as claimed in claim 4 wherein said position determinations and said load determinations are made at fixed time intervals during at least part of the movement of the structure about said vertical axis to and from the bucket unloading position.

6. A method as claimed in claim 4, wherein the position of the bucket is determined by determining the position of a selected point in the bucket to two spaced fixed points of the structure, said two spaced fixed points having a fixed relation to the location at which the load in the structure is determined.

7. A method as claimed in claim 1 or 2 wherein position and load determinations are processed to provide mass determinations only when the bucket is at or above a predetermined height with respect to the structure.

8. A method as claimed in claim 1 or 2 wherein the velocity and acceleration of the structure and the bucket are determined during the movement of the bucket between said loaded and unloading positions in the form of processable kinetic signals, and said kinetic signals are processed to determine that portion of the load at said selected location resulting from said velocity and acceleration and effecting correction to load determination accordingly.

9. A method as claimed in claim 1 or 2 wherein the load at said selected location in the structure is determined by a load cell means that produces an electrical signal proportional to the strain in the structure at said location.

10. In a shovel loader having a bucket supported from a structure, the structure being movable to locate the bucket in respective loaded and unloading positions, apparatus for measuring the quantity of material delivered by the bucket per shovel cycle, said apparatus comprising means to determine the position of the bucket with respect to a selected location in the structure at a plurality of intervals during said movement of the bucket, means to provide a processable position signal indicative of the determined position of the bucket, means to determine the load at a selected location within the structure where the load is related to the mass of the bucket and bucket contents at said intervals during said movement of the bucket, means to produce a processable load signal indicative of the determined load at said location, and processing means to receive said position and load signals for a plurality of interval determinations and calculate therefrom a number of mass determinations of the bucket and bucket contents from the interval determinations made during said movement, and to average said mass determinations to provide a final mass determination of the bucket and bucket contents.

11. In the combination claimed in claim 10 wherein the means to determine the bucket position is adapted to determine the distance of a fixed point on the bucket from each of two spaced fixed points on the structure, and the position signal producing means produces respective signals indicative of each of said distances for supply to the processor means.

12. In the combination claimed in claim 10 or 11 wherein the structure is pivotally about a vertical axis to move the bucket between said loaded and unloading position, and said position and load determining means are operable at preselected intervals during said pivotal movement between said positions in either direction.

13. The combination as claimed in claim 10 wherein, the position determining means and the load determining means are adapted to respectively make bucket position and load first determinations as the bucket moves from the loaded to the unloading position, and second determinations as the bucket moves from the unloading to the loaded position, and said processor means determines the average final mass of the loaded bucket and contents from said first determinations, the average final mass of the unloaded bucket and contents from said second determinations, and the differences between said average final masses.

14. The combination as claimed in 10 or 13 wherein there is provided means to provide a processable signal indicative of the velocity and acceleration of the bucket and the structure when the bucket is moving between the loaded and unloading positions, said processor being programmed to determine from said signal the kinetic load existing at said fixed location in the structure from the velocity and acceleration of the bucket and structure.

15. The combination as claimed in any one of claims 10 or 13 wherein the structure includes a platform, an upwardly extending boom connected at the lower end to the platform, a stay rigidly connected to the platform, and a brace connecting the upper end of the boom to said stay, said bucket being suspended from said boom, and said selected location in the structure being in said stay.

16. A method of measuring the quantity of material delivered per cycle by a shovel loader having a bucket to hold the material to be delivered, the bucket being movable between a loaded and unloading positions, said bucket being supported from a structure during movement between said positions, said method comprising determining the position of the bucket in respect to a selected location on said structure in the form of processable position signal at one or more intervals during said movement, determining the load at a selected location within said structure where the load is related to the mass of the bucket and bucket contents in the form of a processable load signal at said interval or intervals, and processing said position and load signals to determine the mass of the bucket an bucket contents of said interval or intervals, wherein first position determinations and first load determinations are made as the bucket moves from the loaded to the unloading positions, and second position determinations and second load determinations are made as the bucket returns from the unloading position toward the loaded position, processing said position and load signals from said first position and load determinations to determine the mass of the bucket and bucket contents when the bucket is loaded, processing said position and load signals from said second position and load determinations to determine the mass of the bucket and bucket contents after the bucket has been unloaded, and processing the determined mass of the loaded and unloaded bucket to determine the mass of material delivered from the bucket.

17. A method as claimed in claim 16, wherein the position of the bucket is determined by determining the distance from a selected point in the bucket to two spaced fixed points having a fixed relation to the location at which the load in the structure is determined.

18. A method as claimed in claim 16 or 17, wherein the structure is mounted for movement about a vertical axis to effect movement of the bucket between said loaded and unloading positions.

19. A method as claimed in claim 18, wherein said position determinations and said load determinations are made at fixed time intervals during at least part of the movement of the structure about said vertical axis to and from the bucket unloading position.

20. A method as claimed in claim 16 or 17, wherein position and load determinations are processed to provide mass determinations only when the bucket is at or above a predetermined height with respect to the structure.

21. A method as claimed in claim 16 or 17, wherein the velocity and acceleration of the structure and the bucket are determined during the movement of the bucket between said loaded and unloading positions in the form of processable kinetic signals, and said kinetic signals are processed to determine that portion of the load at said selected location resulting from said velocity and acceleration and effecting correction to load determination accordingly.

22. A method as claimed in claim 16 or 17, wherein the load at said selected location in the structure is determined by a load cell means that produces an electrical signal proportional to the strain in the structure at said location.

23. A method of measuring the quantity of material delivered per cycle by a shovel loader comprising a base, a platform supported on the base for rotation relative thereto about a vertical axis, a boom mounted at the lower end on the platform and connected at an upper portion to a stay structure mounted on the platform so the boom extends upwardly and outwardly from the platform, and a bucket supported suspended from the boom and displaceable therefrom in a vertical and horizontal direction, said method comprising determining in the form of an electrical signal the position of the bucket in respect to a selected fixed location in the boom or stay at a plurality of intervals during the rotation of the platform to move the bucket between loaded and unloading positions, determining in the form of an electrical signal the load at a selected fixed location in the boom or said stay structure where the load is related to the mass and position of the bucket and bucket contents, processing said position and load electrical signals for a plurality of interval determinations in an electronic processor to provide a number of mass determination of the bucket and bucket contents from the interval determinations made during said movement, and averaging said mass determinations to provide a final mass determination of the bucket and bucket contents.

* * * * *

UNITED STATES PATENT AND TRADEMARK OFFICE

CERTIFICATE OF CORRECTION

PATENT NO. : 4,809,794

DATED : March 7, 1989

INVENTOR(S) : James R. Blair and Timothy W. Riley

It is certified that error appears in the above-identified patent and that said Letters Patent is hereby corrected as shown below:

Column 1, line 22, delete the words "small large" and substitute therefor --small and large--.

Column 5, line 48, delete the number "8" and substitute therefor --3--.

Column 7, line 21, delete the word "tht" and substitute therefor --that--.

Column 7, line 40, delete the word "Knowning" and substitute therefor --Knowing--.

Column 7, line 41, delete the word "to" and substitute therefor --of the--.

Column 9, line 16, delete the word "not" and substitute therefor --not required to--.

Column 11, line 39, delete the word "laoded" and substitute therefor --loaded--.

Signed and Sealed this

Seventh Day of November, 1989

*Attest:*

JEFFREY M. SAMUELS

*Attesting Officer* *Acting Commissioner of Patents and Trademarks*